United States Patent [19]

Griep

[11] 4,451,779

[45] May 29, 1984

[54] VOLTAGE CONTROLLED CURRENT SOURCE

[75] Inventor: Jonathan P. Griep, Minneapolis, Minn.

[73] Assignee: Honeywell Inc., Minneapolis, Minn.

[21] Appl. No.: 370,694

[22] Filed: Apr. 22, 1982

[51] Int. Cl.[3] ..... G05F 3/08

[52] U.S. Cl. ..... 323/312; 323/280; 323/354; 330/86

[58] Field of Search ..... 323/268–270, 323/280–281, 297, 311–312, 353–354; 307/296 R, 297; 330/84–86, 105, 260

[56] References Cited

U.S. PATENT DOCUMENTS

| | | | |
|---|---|---|---|
| 3,546,564 | 12/1970 | Denny | 323/280 |
| 4,091,333 | 5/1978 | Thrap | 330/86 X |
| 4,349,777 | 9/1982 | Mitamura | 323/297 X |

OTHER PUBLICATIONS

Graeme et al., "Operational Amplifiers, Design and Applications", McGraw-Hill, 1971, Burr-Brown Research Corporation, pp. 201–207.

*Primary Examiner*—Peter S. Wong

*Attorney, Agent, or Firm*—Theodore F. Neils; David R. Fairbairn

[57] ABSTRACT

A voltage controlled current source provides a load current through a load impedance which is a function of an input voltage and is independent of the impedance value of the load impedance. The voltage controlled current source includes a high input impedance unity gain instrumentation amplifier and a resistor connected in series with the load impedance so that current flows through the resistor and the load impedance. The instrumentation amplifier receives the input voltage at its inverting input and receives a load voltage representing the voltage across the load impedance produced by the load current at its noninverting input. The instrumentation amplifier subtracts the input voltage at the inverting input from the load voltage at the noninverting input and multiplies by a gain of one to produce an output voltage at its output. The resistor and the load impedance are connected in series between the output of the amplifier and a reference voltage (e.g. ground), so that the load current is equal to the input voltage divided by the resistance value of the resistor.

8 Claims, 6 Drawing Figures

VOLTAGE CONTROLLED CURRENT SOURCE

BACKGROUND OF THE INVENTION

1. Field of the Invention

The present invention relates to an electrical circuit for providing a current flow through a load impedance which is a function of an input voltage and which is independent of load impedance.

2. Description of the Prior Art

Voltage controlled current source circuits have been developed in the past for providing a current through a load impedance which is independent of the load impedance value and which is controlled by an input voltage. One application for such a circuit is in test instrumentation, where electrical measurements require currents to be supplied as part of the test. For example, in characterizing the properties of an NPN transistor, it is common to use a current source to drive the base of the transistor. The collector current is then measured in order to calculate beta of the transistor. In this type of testing, it is desirable to provide extremely low currents (in the nanoamp range) so as to be able to describe the characteristics of the transistor under test down to very low base currents. In the past, equipment capable of accurately sourcing extremely low currents has been quite complicated and expensive.

The prior art voltage controlled current source circuits typically have used one or more amplifiers together with a resistor network in order to provide a load current which is a function of the input voltage, and which is independent of the load impedance value. Two examples of prior art voltage control current sources are shown in Burr Brown, "Operational Amplifiers: Design in Applications", McGraw Hill, 1971, pages 225–229, FIGS. 6.26 and 6.27. The circuit shown in FIG. 6.26 of this publication uses a single operational amplifier and a network of four resistors. The desired relationship between load current and input voltage is dependent upon a balancing of the various resistance values in order to obtain a predetermined ratio. This circuit also assumes an infinite gain for the operational amplifier. The open loop gain of the operational amplifier, of course, is finite and does affect the accuracy of the circuit. In addition, any deviation of resistance values also results in an error, since a precise relationship between the four resistors is required.

The circuit shown in FIG. 6.27 of the Burr Brown publication is a more complicated circuit including two operational amplifiers and six resistors. Once again, all of the resistors must meet certain mathematical relationships in order for the load current to be a linear function of the input voltage.

Another voltage controlled current source circuit using a pair of operational amplifiers and five resistors is described in Jung, Walter "IC Op Amp Cookbook", SAMS 1980. The linear relationship between load current and input voltage independent of load impedance value requires that the resistors meet a particular mathematical relationship.

Still another voltage controlled current source is shown in "Electronic Design, July 9, 1981, pages 98–100. This circuit uses an instrumentation amplifier and a pair of identical resistors. The output of the instrumentation amplifier is connected through one of the resistors to one terminal of the load. The other resistor connects the inverting input of the instrumentation amplifier to the output. The noninverting input of the amplifier is connected to the load. The amplifier also includes an offset input terminal for receiving the input voltage, which acts as an offset input to the amplifier. The circuit requires that the gain of the amplifier be greater than 10.

There is a continued need for an improved voltage control current source which is capable of accurate operation down to very low load current values, and which is simpler in construction than the prior art circuits.

SUMMARY OF THE INVENTION

The present invention is a voltage controlled current source which provides a load current through load impedance means which is a function of an input voltage and which is independent of load impedance value. The voltage controlled current source of the present invention includes high input impedance unity gain amplifier means having an inverting input terminal, a noninverting input terminal, and an output terminal, and resistance means connected between the output terminal of the amplifier means and the load impedance means. The inverting input terminal of the amplifier means receives the input voltage, and the noninverting input terminal is connected to the load impedance means to receive a load voltage produced by the flow of the load current through the load impedance means. The amplifier means subtracts the input voltage at the inverting input terminal from the load voltage at the noninverting input, and multiplies by a unity gain to produce an output voltage at the output terminal. This output voltage, therefore, is substantially equal to the difference between the load voltage and the input voltage. The amplifier means has a high input impedance, so that an input bias current flowing between the load impedance means and the noninverting input terminal is much less than the load current.

The load current produced by the voltage controlled current source of the present invention is equal to the input voltage divided by the resistance value of the resistance means. If the input voltage is less than zero, the voltage controlled current source sources the load current to the load impedance means. If the input voltage is greater than zero, the voltage control current source sinks the load current from the load impedance means.

DETAILED DESCRIPTION OF THE PREFERRED EMBODIMENTS

Figure 1:
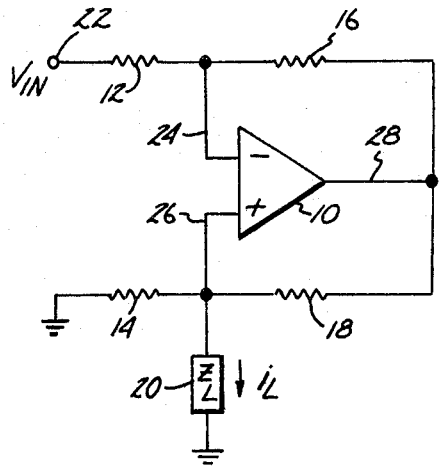
Fig.1 Prior Art
FIGS. 1–4 are electrical schematic diagrams of prior art voltage controlled current source circuits.

The Prior Art Circuit of FIG. 1

Figure 6:
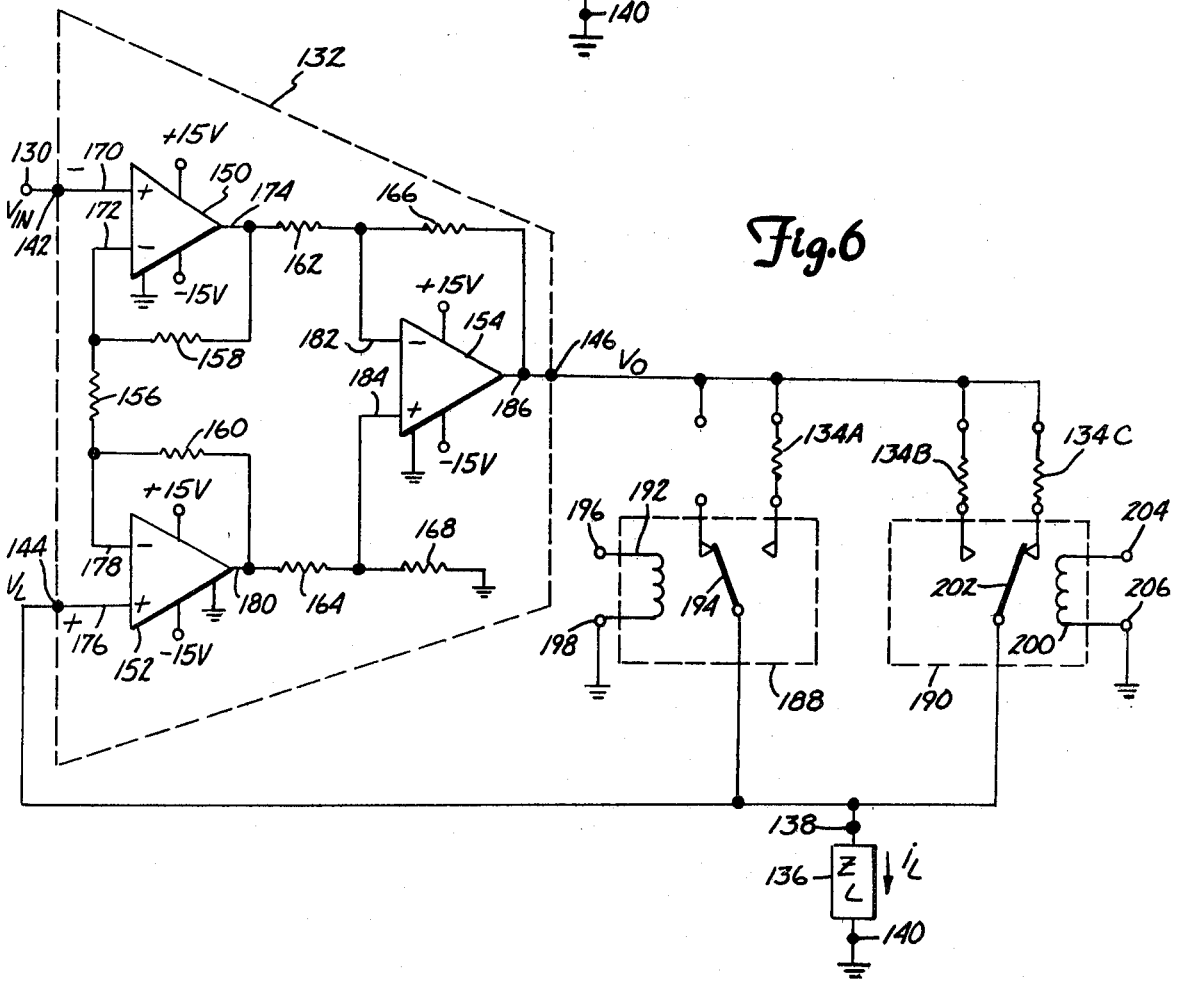
FIG. 6 is a more detailed electrical schematic diagram showing a preferred embodiment of the voltage controlled current source of the present invention.

FIG. 1 shows the previously-mentioned prior art voltage controlled current source which appeared in FIG. 6.26 of the Burr Brown publication "Operational Amplifiers: Design and Applications", McGraw-Hill, 1981, pages 225–229. The prior art circuit shown in FIG. 1 includes operational amplifier 10 and resistors 12, 14, 16 and 18. A load impedance current $i_L$ is supplied by the circuit through load impedance 20. Load current $i_L$ is a function of an input voltage $V_{IN}$ which is supplied to input terminal 22 of the circuit.

Operational amplifier (op amp) 10 has an inverting (−) input 24, a noninverting (+) input 26, and an output 28. Resistor 12 is connected between input terminal 22 of the circuit and inverting input 24 of op amp 10. Resistor 14 is connected between the noninverting input 26 of op amp 10 and ground. Resistor 16 is a feedback resistor connected between output 28 of op amp 10 and inverting input 24. Resistor 18 is connected between output 28 and noninverting input 26. Load 20 is connected between noninverting input 26 and ground.

Op amp 10 has ideally, an infinite open loop gain. In operation, the circuit of FIG. 1 causes the voltages at noninverting input 26 and inverting input 24 to be equal. In other words, the output voltage of op amp 10 varies in order to maintain the difference between the voltages at inputs 24 and 26 equal to zero at all times. The output voltage of op amp 10 is not equal to the voltage difference at its inputs 24 and 26, since that voltage difference is zero.

The objective of the circuit shown in FIG. 1 is to provide a load current $i_L$ through load impedance 20 which is a linear function of input voltage $V_{IN}$ and which is independent of the impedance value $Z_L$ of load impedance 20. This is achieved by proper selection of the values of resistors 12, 14, 16 and 18. Current $i_L$ is given by the following relationship:

$$i_L = -\frac{V_{IN}}{R_{14}}\left[\frac{\left(\frac{R_{14}R_{16}}{R_{12}R_{18}}\right)}{1+\frac{Z_L}{R_{14}}\left(1-\frac{R_{14}R_{16}}{R_{12}R_{18}}\right)}\right] \quad \text{Eq 1}$$

where $R_{12}$=resistance of resistor 12

$R_{14}$=resistance of resistor 14

$R_{16}$=resistance of resistor 16, and $R_{18}$=resistance of resistor 18

If $R_{12}$, $R_{14}$, $R_{16}$ and $R_{18}$ are properly selected so that:

$$(R_{14}R_{16})/(R_{12}R_{18})=1, \quad \text{Eq 2}$$

then the load current $i_L$ is independent of the impedance value $Z_L$ of load impedance 20:

$$i_L=-V_{IN}/R_{14}. \quad \text{Eq 3}$$

In practice, of course, it is difficult to achieve precise balancing of resistance values $R_{12}$, $R_{14}$, $R_{16}$ and $R_{18}$ so as to satisfy Equation 2, particularly since the resistance values are normally unequal in order to provide proper operation of the circuit over the range of input voltages $V_{IN}$ and the expected ranges of load impedance value $Z_L$. Even when resistors 12, 14, 16 and 18 nominally meet the balance condition, the normal tolerances for each of the resistors result in a deviation from the simplified relationship shown in Equation 3. The actual relationship between $i_L$ and $V_{IN}$, including error terms, can be expressed as follows:

$$i_L=-(V_{IN}/R_{14})\,[1+E] \quad \text{Eq 4}$$

where E=error

The error term E of Equation 4 as a result of errors (tolerances) of the individual resistors 12, 14, 16 and 18 is given by:

$$E=|r_{16}|+|r_{12}|+|r_{18}|+(Z_L/R_{14})(2|r_{14}|+|r_{12}|+|r_{18}|+|r_{16}|) \quad \text{Eq 5}$$

where $|r_{12}|$=error (tolerance) for resistor 12, etc.

In addition to the error produced by the circuit of FIG. 1, which can be significant, there are other important disadvantages. First, the circuit requires a precise balancing of four resistors of different values. This can be a difficult and time-consuming task.

Second, any change in the range of values of $i_L$ requires a complete redesign of the circuit, due to the complex relationship of all of the resistance values. Although in the balanced condition $i_L$ is a function of only $V_{IN}$ and $R_{14}$, it is not possible to simply change the value of $R_{14}$ without changing all of the other resistance values as well. In many applications, the values of $V_{IN}$ can be provided accurately only over a limited range of voltages (for example from −10 volts to +10 volts). If this input voltage range does not produce the entire range of load currents which is needed, either an input voltage source with a wider input voltage range or multiple circuits like that shown in FIG. 1 will be required in order to cover the entire current range. In either case, this significanty increases the cost and complexity.

Third, the prior art circuit of FIG. 1 utilizes operational amplifier 10. For the purpose of easy analysis, an infinite open loop gain has been assumed. In practice, however, the open loop gain of operational amplifiers is finite, and does affect operation. As a result, additional error terms can be produced.

Figure 2:
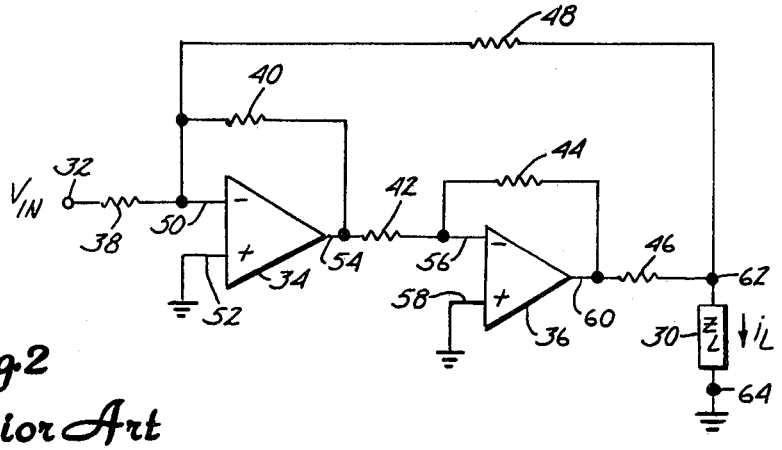
Fig.2 Prior Art

The Prior Art Circuit of FIG. 2

FIG. 2 is an electrical schematical diagram of another voltage controlled current source circuit disclosed in FIG. 6.27 of Burr Brown "Operational Amplifiers: Design and Applications". This circuit sources a load current $i_L$ through load impedance 30 as a function of the input voltage $V_{IN}$ supplied at input terminal 32. The circuit includes a pair of operational amplifiers (op amps) 34 and 36, and resistors 38, 40, 42, 44, 46 and 48.

Resistor 38 is connected between input terminal 32 and inverting input 50 of op amp 34. Noninverting input 52 of op amp 34 is connected to ground. Resistor 40 is a feedback resistor which is connected between output 54 and inverting input 50 of op amp 34. Resistor 42 connects output 54 of op amp 34 with inverting input 56 of op amp 36. Noninverting input 58 of op amp 36 is connected to ground. Resistor 44 is a feedback resistor connected between output 60 of op amp 36 and inverting input 56. Output 60 of op amp 36 is connected through resistor 46 to terminal 62 of load impedance 30. Opposite terminal 64 of load impedance 30 is connected to ground. Resistor 48 is another feedback resistor which is connected between terminal 62 of load impedance 30 and inverting input 50 of op amp 34.

As with the circuit shown in FIG. 1, the prior art circuit shown in FIG. 2 requires a balancing of the various resistances in order to provide a load current $i_L$ which is a function of $V_{IN}$, and which is essentially independent of the load impedance value $Z_L$ of load impedance 30.

$$i_L = \frac{V_{IN}\left(\frac{R_{44}}{R_{42}}\right)\left(\frac{R_{40}}{R_{38}}\right)}{R_{46}\left[1+\left(\frac{Z_L}{R_{46}}\right)\left(1+\left(\frac{R_{46}}{R_{48}}\right)-\left(\frac{R_{44}}{R_{42}}\right)\left(\frac{R_{40}}{R_{48}}\right)\right)\right]} \quad \text{Eq 6}$$

A balance condition occurs if and only if:

$$1+(R_{46}/R_{48})=(R_{44}\,R_{40})/(R_{42}\,R_{48}) \quad \text{Eq 7}$$

and $$R_{44}R_{40}=R_{42}\,R_{38} \quad \text{Eq 8}$$

The worse case error due to resistor tolerances can be expressed as follows:

$$i_L=(V_{IN}/R_3)\,[1+E] \quad \text{Eq 9}$$

where $E=|r_{44}|+|r_{42}|+|r_{40}|+|r_{38}|+(Z_L/R_{46})(2|r_{46}|+2|r_{48}+|r_{44}|+|r_{42}|+|r_{40}|)$ The text recommends choosing a small resistance value for resistor $R_{46}$ to minimize voltage drop. If load impedance 30 is, for example, a base emitter junction at low base current, then the $Z/R_{46}$ error term becomes significant, and the circuit does not provide a load current $i_L$ independent of load impedance value $Z_L$.

The prior art circuit of FIG. 2 suffers from the same disadvantages discussed above with respect to the circuit of FIG. 1.

Figure 3:
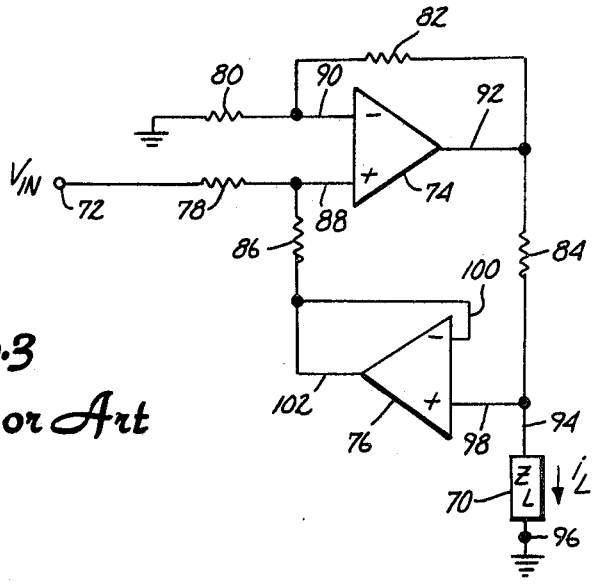
Fig.3 Prior Art

The Prior Art Circuit of FIG. 3

The circuit shown in FIG. 3 is a prior art voltage control current source circuit described in Jung, Walter, "IC Op Amp Cookbook", *SAMS*, 1980. This circuit sources a load current $i_L$ through load impedance 70 which is a function of input voltage $V_{IN}$ supplied at input terminal 72.

The circuit of FIG. 3 includes a pair of op amps 74 and 76, together with resistors 78, 80, 82, 84 and 86. Like the circuit shown in FIGS. 1 and 2, the circuit depends upon a balancing of the various resistance values in order to provide a load current $i_L$ which is independent of the impedance value $Z_L$ of load impedance 70.

In FIG. 3, input terminal 72 is connected through resistor 78 to noninverting input 88 of op amp 74. Inverting input 90 of op amp 74 is connected through resistor 80 to ground. Resistor 82 is a feedback resistor which connects output 92 of op amp 74 to inverting input 90. Resistor 84 is connected between output 92 of op amp 74 and terminal 94 of load impedance 70. Terminal 96 of load impedance 70 is connected to ground.

Op amp 76 has its noninverting input 98 connected to terminal 94 of load impedance 70. Inverting input 100 and output 102 of op amp 76 are connected together. Resistor 86 connects output 102 of op amp 76 to noninverting input 88 of op amp 74.

In the balanced condition, load current $i_L$ is:

$$i_L=V_{IN}\,(R_{86}/R_{78}\,R_{84}) \quad \text{Eq 10}$$

The balanced condition occurs if and only if:

$$R_{80}\,R_{86}=R_{78}\,R_{82} \quad \text{Eq 11}$$

The worse case error for the prior art circuit shown in FIG. 3 due to resistance tolerances may be expressed as follows:

$$i_L=V_{IN}(R_{86}/R_{78}\,R_{84})\,[1+E]$$

Eq 12 where $E = 2\,|r_{80}| + 3\,|r_{78}| + 2\,|r_{82}| + |r_{86}| + |r_{84}| + \frac{Z_L}{R_{84}} \cdot \frac{1}{\left(1+\frac{R_{78}}{R_{86}}\right)}(3\,|r_{78}| + 2\,|r_{80}| + 2\,|r_{82}| + 3\,|r_{86}| + |r_{84}|)$ The prior art circuit shown in FIG. 3 suffers from the same disadvantages discussed with respect to the circuits of FIGS. 1 and 2. It requires a precise balancing of five different resistance values. This makes a change of current range impractical—the circuit is basically designed for a single current range since any change in current range requires new values for all five resistors.

Figure 4:
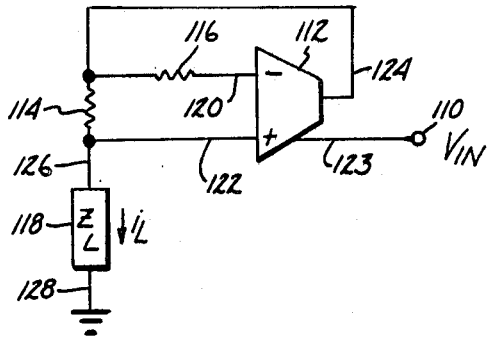
Fig.4 Prior Art

The Prior Art Circuit of FIG. 4

FIG. 4 shows another prior art voltage control current circuit which was described by Nelson, Carl "Monolithic Amp Delivers Instrument Precision", *Electronics Design*, July 9, 1981, pages 98–100. The circuit of FIG. 4 includes an input terminal 110, instrumentation amplifier 12, and a pair of matched resistors 114 and 116 which have a resistance R. The circuit supplies a load current $i_L$ through load impedance 118 which is:

$$i_L=V_{IN}/RG \quad \text{Eq 13}$$

where G = gain of amplifier 112

Instrumentation amplifier 112 has an inverting input 120, an noninverting input 122, an offset input 123, and an output 124. Amplifier 112 subtracts the voltage present at inverting input 120 from the voltage present at noninverting input 122 multiplies by gain G, and then adds the offset voltage $V_{IN}$ at input 123 to produce an output voltage at output terminal 124. Resistor 114 is connected between output 124 of amplifier 112 and terminal 126 of load impedance 118.

Due to approximations in the derivation of Equation 13, the circuit of FIG. 4 requires that gain G of amplifier 112 be at least ten (10). The circuit has an error term which may be expressed as follows:

$$E = |g| + |r| + \frac{1}{G}\left(1+\frac{Z_L}{R}\right) \quad \text{Eq 14}$$

where $|g|$ = gain error where $|r|$ = resistor tolerance

As can be seen from Equation 14, in order to reduce the error term E, and reduce the dependence on the load impedance value $Z_L$, the value of gain G must be increased. This in turn decreases the bandwidth of the circuit, an undesirable characteristic, and electrical noise can become a problem.

Figure 5:
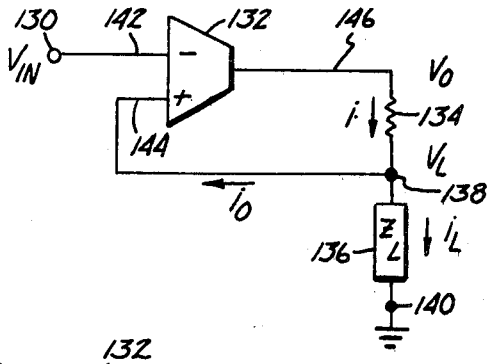
FIG. 5 is an electrical schematic diagram of the voltage controlled current source of the present invention.

The Voltage Controlled Current Source Circuit of The Present Invention (FIGS. 5 and 6)

FIG. 5 is an electrical schematic diagram of the voltage controlled current source of the present invention.

The circuit includes an input terminal 130, high input impedance unity gain instrumentation amplifier 132, and resistor 134. The circuit forces a load current $i_L$ through load impedance 136. When $V_{IN}$ is less than zero, the circuit sources current through load impedance 136 from terminal 138 to ground terminal 140 as illustrated in FIG. 5. If $V_{IN}$ is greater than zero, the circuit sinks current flowing from ground terminal 140 through load impedance 136 to terminal 138. For ease of illustration and discussion, the circuit of the present invention will be described in its current sourcing function, but it should be understood that with a reversal of polarities of input voltage $V_{IN}$, (i.e. with $V_{IN}$ a positive voltage), the circuit will operate in an identical manner in its current sinking function.

Instrumentation amplifier 132 has its inverting input 142 connected to input terminal 130, and its noninverting input 144 connected to terminal 138 of load impedance 136. Resistor 134 is connected between output 146 of amplifier 132 and terminal 138 of load impedance 136.

In the preferred embodiment of the present invention shown in FIG. 5, amplifier 132 is a unity gain, high input impedance instrumentation amplifier. Amplifier 132 subtracts the input voltage $-V_{IN}$ (which is a negative voltage since the circuit is operating in a current sourcing mode) supplied at its inverting input 142 from a load voltage $V_L$ which is fed back to its noninverting input 144. Load voltage $V_L$ represents the voltage produced across load impedance 136 by load current $i_L$. Amplifier 132 multiplies this difference by its gain G, which is one (i.e. unity gain) to produce an output voltage $V_O$ at output 146.

$$V_O = G[V_L - (-V_{IN})] = V_L + V_{IN} \qquad \text{Eq 15}$$

since G=1.

In other words, the output voltage of amplifier 132 is substantially equal to the difference between the load voltage ($V_L$) at its noninverting input 144 and the input voltage (in this case $-V_{IN}$) at its inverting input 142. This is unlike the operation of op amp 10, for example, of the prior art circuit of FIG. 1. Op amp 10 does not produce an output voltage which is substantially equal to the difference between voltages at its inputs 24 and 26, because that voltage difference is maintained at zero by the prior art circuit of FIG. 1.

Since resistor 134 and load impedance 136 are connected in series between output 146 and ground terminal 140, output voltage $V_O$ can also be expressed as follows:

$$V_O = V_R + V_L \qquad \text{Eq 16}$$

where $V_R$=voltage across resistor 136.

Combining Equations 15 and 16 yields:

$$V_L + V_{IN} = V_R + V_L$$
$$V_{IN} = V_R \qquad \text{Eq 17}$$

As shown in FIG. 5, the current i flowing through resistor 134 is:

$$i = i_L + i_O \qquad \text{Eq 18}$$

The input bias current $i_O$ which flows between terminal 138 of load impedance 136 and noninverting input 144 of amplifier 132 is very small, much smaller than load current $i_L$. The input impedance of amplifier 132 (which is preferably about $10^{12}$ ohms) ensures that input bias current i is very small (typically in the picoamp range). This allows the circuit of FIG. 5 to operate down into the nanoamp range without considering any error due to bias current $i_O$. In other words, the current $i_O$ flowing through resistor 134 is essentially equal to the load current $i_L$ flowing through load impedance 136 for practical purposes, and the input bias current $i_O$ can be ignored. It can be seen, therefore, that the circuit of FIG. 5 produces a load current $i_L$ which is a linear function of $V_{IN}$ and which is independent of load impedance value $Z_L$.

$$V_R = iR \approx i_L R \qquad \text{Eq 19}$$

where R=resistance of resistor 136.

Rearranging Equation 19 and substituting Equation 17 yields:

$$i_L \approx V_{In}/R \qquad \text{Eq 20}$$

Resistor 134, therefore, sets the value of $i_L$ being forced through load impedance 136 for a particular value of input voltage $V_{IN}$. The circuit of the present invention does not require balancing of several resistors. As a result, the range of load currents $i_L$ produced for a given range of input voltages $V_{IN}$ can be rapidly and easily changed simply by changing the resistance value of resistor 134. This can be easily accomplished by providing several resistors in parallel, and selectively switching the resistors into the circuit by means of a relay. This significant advantage of the present invention will be described in further detail with respect to the circuit of FIG. 6.

In addition to setting the current being forced through load impedance 136, resistor 134 also is selected so that amplifier 132 stays below its maximum output voltage. In other words:

$$R \leqq \frac{V_{IM}}{(V_{OM} - V_{IM})} Z_L \qquad \text{Eq 21}$$

where $V_{IM}$=maximum value of $|V_{IN}|$ $V_{OM}$=maximum value of $|V_O|$.

Because the accuracy of the relationship between load current $I_L$ and input voltage $V_{IN}$ depends upon resistance value R, resistor 134 is preferably a precision resistor (0.1% tolerance or better) which is stable over the operating temperature range of the circuit. The precision resistance is necessary to the accuracy of the load current value $i_L$ for a particular input voltage value $V_{IN}$.

The foregoing description of the operation of the circuit of the present invention has described ideal operation of the circuit. In any practical circuit, of course, there are error terms which cause the operation of the circuit to deviate from ideal performance. In the case of the circuit of the present invention, the error terms arise from two sources: resistance tolerance of resistor 134 and deviations of gain G of amplifier 132 from unity. In the following analysis, the worse case error of the circuit of the present invention will be derived, using the following more precise expressions for resistance R and gain G:

$$R = R_O(1+r) \qquad \text{Eq 22}$$

where $R_O$=nominal resistance of resistor 134 r=tolerance of resistor 134.

$$G=1+g \quad \text{Eq 23}$$

where G=deviation of amplifier 132 from unity gain.

Using Equations 22 and 23, and still assuming that input bias current $i_O$ is approximately zero, the value of load current $i_L$ with error terms can be derived as follows:

$$V_o = G(V_L - V_{IN}) \text{ But } V_L = \beta V_o \quad \text{Eq 24}$$

$$\text{And } \beta = \frac{Z_L}{R + Z_L}$$

$$V_o = -GV_{IN} + G\beta V_o = -GV_{IN}\left[\frac{1}{1 - G\beta}\right] \quad \text{Eq 25}$$

$$V_o = \frac{-(1+g)V_{IN}}{1 - \left(\frac{Z_L}{R + Z_L}\right)}(1+g) \quad \text{Eq 26}$$

$$= \frac{-(1+g)(R+Z_L)V_{IN}}{R_o(1+r) + Z_L - (1+g)Z_L}$$

$$i_L = \frac{V_o}{R + Z_L} = \frac{-(1+g)V_{IN}}{R_o\left[1 + r + \frac{Z_L}{R_o} - (1+g)\frac{Z_L}{R_o}\right]} \quad \text{Eq 27}$$

$$= \frac{-(1+g)V_{IN}}{R_o\left[1 + r - g\left(\frac{Z_L}{R_o}\right)\right]}$$

$$\text{If } r - g\left(\frac{Z_L}{R_o}\right) << 1 \text{ then}$$

$$i_L = \frac{-V_{IN}}{R_o}(1+g)\left(1 - r + g\left(\frac{Z_L}{R_o}\right)\right) \quad \text{Eq 28}$$

$$= \frac{-V_{IN}}{R_o}\left[1 - r + g\left(1 + \frac{Z_L}{R_o}\right)\right]$$

The worse case error E of the circuit of FIG. 5 can then be expressed as follows:

$$E=|g|+|r|+|g|(Z_L/R_O) \quad \text{Eq 29}$$

A comparison of the worse case error produced by the circuit of FIG. 5 with the worse case errors produced by each of the prior art circuits shown in FIGS. 1–4 reveals the improved accuracy of the voltage controlled current source of the present invention. Assuming a 0.1% tolerance for resistor 134 (i.e. $|r|=0.001$) and a deviation from unity gain of 0.25% ($|g|=0.0025$), the worse case error for the circuit of FIG. 5 is:

$$E = .001 + .0025\left(1 + \frac{Z_L}{R_o}\right) \quad \text{Eq 30}$$

-continued $$= .0035 + .0025\left(\frac{Z_L}{R_o}\right)$$

In comparison, if resistance tolerances of 0.1% are assumed for the prior art circuit of FIG. 1, the worse case error as given in Equation 5 is:

$$E=0.003+0.005(Z_L/R_{14}) \quad \text{Eq 31}$$

The worse case error for the prior art circuit of FIG. 2 is shown in Equation 9. Assuming resistance tolerances of 0.1% yields the following worse case error for the circuit of FIG. 2:

$$E=0.004+0.007(Z_L/R_{46}) \quad \text{Eq 32}$$

The worse case error for the circuit of FIG. 3 is given by Equation 12. Assuming 0.1% resistance tolerances yield the following worse case error:

$$E = .009 + (.011)\frac{Z_L}{R_{84}} \cdot \frac{1}{\left(1 + \frac{R_{78}}{R_{86}}\right)} \quad \text{Eq 33}$$

A comparison of Equations 30–33 shows that the worse case error of the circuit of the present invention is less than or comparable to the error of the circuit of FIG. 1, and is clearly less than the worse case errors of the circuits of FIGS. 2 and 3.

As for the prior art circuit of FIG. 4, a comparison of Equations 14 and 29 reveals an important difference between the prior art circuit of FIG. 4 and the circuit of the present invention shown in FIG. 5. While the first two terms of Equations 14 and 29 are the same, the final terms differ in a very important respect. In the prior art circuit of FIG. 4, the final error term of Equation 14 is a function of the gain G. In contrast, in the circuit of the present invention the final term is a function of $|g|$, the deviation of the gain from unity. In the circuit of FIG. 5, therefore, the gain G must be increased in order to reduce the final error term. As discussed previously, increasing gain G decreases bandwidth and electrical noise may become a problem with the circuit of FIG. 4.

In addition to the improved accuracy, the circuit of the present invention, as shown in FIG. 5 has several other important advantages over the prior art circuits. In particular, it does not require a complicated balancing of several resistance values in order to achieve proper operation. It is, therefore, much easier to design and construct than the prior art circuits.

In addition, current ranges can be changed with the circuit of the present invention by changing only a single resistance value. The change in the resistance value of resistor 134 does not require a change in any other circuit component, unlike the prior art circuits. Since the range of input voltages available may often be much more limited than the desired range of load currents, the ability to change current range rapidly and simply by changing a single resistance value is an important advantage of the present invention.

The voltage controlled current source of the present invention is capable of operation down into the nanoamp range, which makes it particularly useful for testing characteristics of transistors. When used in conjunction with a programmable voltage source, the voltage controlled current source of the present invention has been used successfully to test characteristics of transistors down to very low base currents (in the nanoamp range). The present invention is far less complex and less expensive than other test equipment used for similar purposes.

FIG. 6 shows a more detailed schematic diagram of a preferred embodiment of the voltage controlled current source of the present invention. The circuit shown in FIG. 6 is generally similar in construction to the circuit of FIG. 5, and similar reference characters are used to designate similar elements.

In the circuit of FIG. 6, instrumentation amplifier 134 is formed by three operational amplifiers 150, 152 and 154 and resistors 156, 158, 160, 162, 164, 166 and 168. First input op amp 150 receives input voltage $V_{IN}$ at the inverting input 142 of instrumentation amplifier 132, while second input op amp 152 receives the load voltage at the noninverting input 144 of amplifier 132. The signals from first and second input op amps 150 and 152 are supplied to output op amp 154, which supplies the output voltage $V_O$ at output terminal 146 of amplifier 132. This output voltage $V_O$ is equal to the difference between the load voltage $V_L$ and the input voltage $V_{IN}$.

First input op amp 150 has a noninverting input 170 which acts as input 142 of amplifier 132 to receive the input voltage $V_{IN}$. Noninverting input 172 and output 174 of first input op amp 150 are connected by feedback resistor 158.

Similarly, noninverting input 176 of second input op amp 152 acts as the noninverting input 144 of amplifier 132 to receive load voltage $V_L$. Inverting input 178 and output 180 of second input op amp 152 are connected together by feedback resistor 160. Resistor 156 is connected between inverting inputs 172 and 178 of first and second input op amps 150 and 152, respectively.

Output 174 of first input op amp 150 is connected through resistor 162 to inverting input 182 of output op amp 154. Similarly, output 180 of second input op amp 152 is connected through resistor 164 to noninverting input 184 of output op amp 154. Resistor 166 connects output 186 of output op amp 154 with inverting input 182. Resistor 168 is connected between noninverting input 184 and ground.

The gain G of amplifier 132 is determined by the resistance values of resistors 156, 158, 160, 162, 164, 166 and 168 according to the following relationship:

$$G=(R_D/R_C)[1+2(R_B/R_A)] \qquad \text{Eq 34}$$

where $R_A$=resistance of resistor 156

$R_B$=resistance of resistor 158 and 160

$R_C$=resistance of resistor 162 and 164

$R_D$=resistance of resistor 166 and 168

By proper selection of resistances values $R_A$, $R_B$, $R_C$, and $R_D$, a unity gain is achieved.

In the circuit of FIG. 6, resistor 134 has been replaced by three separate resistors 134A, 134B and 134C which are selectable individually or in combination by relays 188 and 190. This allows different current ranges to be selected.

Relay 188 is a read relay having a coil 192 and contacts 194. Coil 192 is connected between input terminal 196 and ground terminal 198 so that it is energized when a voltage is applied to input terminal 196. Reed relay 188 is shown in its normally closed (i.e. coil 192 de-energized) position in FIG. 6. When coil 192 is energized, contacts 194 move to a position which connects resistor 134A in series with load impedance 136.

Relay 190 is a read relay having coil 200 and contacts 202. Coil 200 is connected between input terminal 204 and ground terminal 206, so that coil 200 is energized when voltage is applied to input terminal 204. Contacts 202 are shown in their normally closed position in FIG. 6, which occurs when coil 200 is deenergized. In the normally closed position, relay contacts 202 connect resistor 134C in series with load impedance 136. When coil 200 is energized by an input voltage at terminal 204, contacts 202 move to a position which connects resistor 134B in series with load impedance 136.

The components used to construct one successful embodiment of the circuit shown in FIG. 6 are listed in the following table:

TABLE

| | | |
|---|---|---|
| Op amp | 150 | Burr Brown 3527 |
| Op amp | 152 | Burr Brown 3527 |
| Op amp | 154 | Burr Brown 3527 |
| Reisitor | 134A | 10.1K (1%) |
| Resistor | 134B | 100K (1%) |
| Resistor | 134C | 1 Meg (1%) |
| Resistor | 156 | 10.0180K |
| Resistor | 158 | 5.0037K |
| Resistor | 160 | 4.9973K |
| Resistor | 162 | 20.017K |
| Resistor | 164 | 20.016K |
| Resistor | 166 | 10.189K |
| Resistor | 168 | 10.194K |
| Reed Relay | 188 | DIP Reed Relay Form IC DL1C05 |
| Reed Relay | 190 | DIP Reed Relay Form IC DL1C05 |

The circuit of FIG. 6 was tested using four different load impedances to determine the accuracy of operation of the circuit over a range of input voltages. In making this determination, a comparison was made between the load current expected for a particular input voltage and a measured load current.

In the first test, load impedance 136 was a Keithley 169 ammeter connected between terminals 138 and 140. In the second test, load impedance 136 was a 10.6 meg ohm resistor connected in series with a Keithley 169 ammeter between terminals 138 and 140.

In the third test, load impedance 136 was a 10K resistor, the base—emitter junction of a Honeywell NPN HS19 transistor, and the Keithley 169 ammeter. The 10K resistor was connected between terminal 138 and the base of the HS19 transistor. The Keithley 619 ammeter was connected between the emitter of the transistor and ground terminal 140. The collector of the transistor was unconnected.

In the fourth test, load impedance 136 was simply the base—emitter junction of a Honeywell NPN HS19 transistor in series with the Keithley 619 ammeter. The base of the transistor was connected to terminal 138, and the Keithley 619 ammeter was connected between the emitter of the transistor and ground terminal 140. The collector of the transistor was unconnected.

The results of the testing showed that the percentage difference between the expected and measured load currents was no more than 1% for all four of the load impedances tested. In other words, the circuit of FIG. 6 showed an accuracy of 1% or better for the variety of different load impedances. In this testing, the circuit also showed excellent repeatability and reliability.

Conclusion

The voltage controlled current source circuit of the present invention forces a current through a load impedance which is equal to the input voltage divided by the resistance value connected between the output of a unity gain amplifier and the load impedance. The circuit is simple in construction, uses a minimum of components, and provides very high accuracy down to extremely low currents.

Because the load current is determined by a single resistance value, current ranges can be changed simply by changing that single resistance value. By simply changing the polarity of the input voltage, the circuit of the present invention can be used either to sink current or to source current through the load impedance. In either case, the load current is independent of the impedance value of the load impedance.

Although the present invention has been described with reference to preferred embodiments, workers skilled in the art will recognize that changes may be made in form and detail without departing from the spirit and scope of the invention. For example, although amplifier 132 shown in the preferred embodiments of the present invention is a high input impedance instrumentation amplifier, the present invention can also utilize a differential amplifier, provided that the amplifier has high input impedance, has a unity gain, and subtracts the input voltage at one input from the load voltage at another input to produce the output voltage which is substantially equal to the difference between the load voltage and the input voltage.

What is claimed is:

1. A voltage controlled current source for providing a desired load current through a selected load impedance means which is a function of a provided input voltage taken with respect to a provided reference voltage and which load current is substantially independent of that impedance value chosen for the load impedance means, the voltage controlled current source comprising:

a high input impedance unity gain amplifier means having a first input, a second input and an output, the first input adapted to receive the input voltage and the second input adapted to receive that load voltage provided by flow of the load current through the load impedance means, the amplifier means providing an output voltage at the output thereof which is substantially equal to that difference occurring between the load voltage and the input voltage as provided; and a resistance means adapted to be electrically connected in a series current path with the load impedance means between the output of the amplifier means and the reference voltage so that load current values are substantially equal to values of the input voltage provided divided by that value of resistance selected for the resistance means.

2. The voltage controlled current source of claim 1 wherein the unity gain amplifier means is an instrumentation amplifier having a first input amplifier connected to the first input for receiving the input voltage, a second input amplifier connected to the second input for receiving the load voltage, and an output amplifier for receiving a first voltage from an output of the first input amplifier and a second voltage from an output of the second amplifier and for providing at the output of the unity gain amplifier means the output voltage based upon the first and second voltages.

3. The voltage controlled current source of claim 1 wherein the resistance means is connected in the series current path with the load impedance means between the output of the amplifier means and ground.

4. The voltage controlled current source of claim 1 wherein the resistance means comprises a plurality of resistors and switching means for selectively connecting the resistors to provide different resistance values of the resistance means and thus different load current ranges.

5. A voltage controlled current source for providing a desired load current through a selected load impedance means which is a function of a provided input voltage taken with respect to a provided reference voltage and which load current is substantially independent of that impedance value chosen for the load impedance means, the voltage controlled current source comprising:

a unity gain amplifier means having an inverting input and a noninverting input and an output, the inverting input adapted to receive the input voltage and the noninverting input adapted to receive that load voltage provided by flow of the load current through the load impedance means, the amplifier means providing an output voltage at the output thereof which is substantially equal to that difference occurring between the load voltage and the input voltage as provided; and a resistance means electrically connected to the output of the amplifier means and adapted to be electrically connected to the load impedance means from which connection also an input bias current flows to the noninverting input of the unity gain amplifier means where such noninverting input has a high input impedance causing this input bias current to be much less than the load current so that current flowing through the resistance means is substantially equal to the load current and the load current values are substantially equal to values of the input voltage provided divided by that value of resistance selected for the resistance means.

6. The voltage controlled current source of claim 5 wherein in the unity gain amplifier means is an instrumentation amplifier having a first input amplifier connected to the inverting input for receiving the input voltage, a second input amplifier connected to the noninverting input for receiving the load voltage, and an output amplifier for receiving a first voltage from an output of the first input amplifier and a second voltage from an output of the second amplifier and for providing at the output of the unity gain amplifier means the output voltage based upon the first and second voltages.

7. The voltage controlled current source of claim 5 wherein the resistance means is connected in a series current path with the load between the output of the amplifier means and the reference voltage.

8. The voltage controlled current source of claim 5 wherein the resistance means comprises a plurality of resistors and switching means for selectively connecting the resistors to provide different resistance values of the resistance means and thus different load current ranges.

* * * * *